United States Patent [19]

Matt

[11] Patent Number: 4,602,699

[45] Date of Patent: Jul. 29, 1986

[54] FIRE ESCAPE WITH CABLE REEL BRAKE

[75] Inventor: Edvin Matt, Lawtell, La.

[73] Assignee: Luke Bourgeois, Oplousas, La.

[21] Appl. No.: 692,694

[22] Filed: Jan. 18, 1985

[51] Int. Cl.[4] ..... A62B 1/10

[52] U.S. Cl. ..... 182/234; 182/239

[58] Field of Search ..... 182/5.7, 231, 234, 239, 182/75, 71

[56] References Cited

U.S. PATENT DOCUMENTS

| | | | |
|---|---|---|---|
| 194,536 | 8/1877 | Benjamin . | |
| 396,852 | 1/1889 | Pelkey . | |
| 425,554 | 4/1890 | Hilton . | |
| 482,654 | 9/1892 | Sansousy . | |
| 702,259 | 6/1902 | Tardif . | |
| 752,279 | 2/1904 | Bacon . | |
| 772,056 | 10/1904 | Ragsdale . | |
| 779,284 | 1/1905 | Johnson . | |
| 787,394 | 4/1905 | Peters . | |
| 990,029 | 4/1911 | Borden . | |
| 1,296,052 | 3/1919 | Dietz . | |
| 1,490,524 | 4/1924 | Wood | 182/239 |
| 1,541,590 | 6/1925 | Ryba . | |
| 1,593,704 | 7/1926 | Morris . | |
| 2,122,315 | 6/1938 | Fosty . | |
| 2,518,934 | 8/1950 | Renner . | |
| 2,761,650 | 9/1956 | Faugier . | |
| 4,253,643 | 3/1981 | Forester . | |

*Primary Examiner*—Reinaldo P. Machado

*Attorney, Agent, or Firm*—Harvey B. Jacobson

[57] ABSTRACT

A fire escape device having a housing and cable drum rotatable therein with a cable connected thereto and extending from the housing for connection with a supporting structure with the housing being connected to a person descending from an upper floor of a building or the like during an emergency situation such as a fire with an automatic brake mechanism controlling the rate of descent of such a person by applying a braking force to a rotatable component geared to the cable drum for controlling unreeling movement of the cable.

4 Claims, 5 Drawing Figures

FIRE ESCAPE WITH CABLE REEL BRAKE

BACKGROUND OF THE INVENTION

1. Field of the Invention

The present invention generally relates to a fire escape device having a cable drum mounted thereon together with a brake that is centrifugally actuated for regulating the speed of the cable being unwound from the drum thereby automatically regulating the rate of descent of a person supported by the device as the cable unreels from the drum.

2. Description of Related Art

Many devices have been provided to assist persons entrapped on upper floor levels of a burning building or the like to safely escape without injury. Some of theses devices involve a cable that is wound on a drum attached to a supporting structure so that as the person supported from the fire escape device descends by the cable unwinding from the drum, brake arrangements are provided for slowing the rate of descent of the person to avoid injury as a result of excessive velocity. The following U.S. patents disclose various devices for this general purpose. U.S. Pat. Nos. 194,536; 396,852; 425,554; 482,654; 702,259; 752,279; 772,056; 779,284; 787,394; 990,029; 1,296,052; 1,541,590; 1,593,704; 2,518,934; 2,122,315; 2,761,650; 4,253,643.

SUMMARY OF THE INVENTION

An object of the present invention is to provide a fire escape device that includes a cable drum having an anchor cable wound thereon together with a gear driven centrifugal weight assembly actuating a brake mechanism automatically in response to the rotational speed of the cable drum so that application of a braking force will vary in accordance with the rate of descent of a person supported from a housing for the cable drum and brake mechanism thereby avoiding the necessity of the person descending from an elevated position manipulating a brake mechanism so that the device may be used by persons incapable of manually operating a brake machanism.

Another object of the invention is to provide a fire escape device in accordance with the preceding object in which the brake machanism includes oppositely disposed brake devices having a centrifugal weight assembly disposed therebetween to move the brake mechanisms between operative and inoperative positions in response to rotational movement of the centrifugal weight assemblies.

Still another object of the invention is to provide a fire escape device in accordance with the preceding objects in which the brake assemblies and the centrifugal weight assemblies are mounted on a shaft rotatably driven from the cable drum by a gear mechanism having a speed increase ratio whereby the rotational speed of the centrifugal weight assemblies will be substantially greater than the rotational speed of the cable drum.

Yet another object of the invention is to provide a fire escape device with automatic brake as set forth in the preceding objects which is simple to use, automatic in operation, safe, dependable, long lasting and substantially foolproof in operation.

These together with objects and advantages which will become subsequently apparent reside in the details of construction and operation as more fully hereinafter described and claimed, reference being had to the accompanying drawings forming a part hereof, wherein like numerals refer to like parts throughout.

BRIEF DESRIPTION OF THE DRAWINGS

DESCRIPTION OF THE PREFERRED EMBODIMENTS

Figure 1:
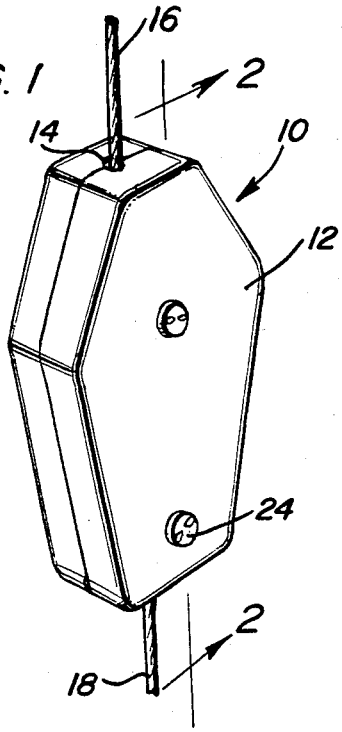
FIG. 1 is a perspective view of the fire escpae device of the present invention.

Referring now specifically to the drawings, the fire escape device of the present invention is generally designated by the numeral 10 and includes a hollow housing 12 constructed of two housing components joined together in abutting relationship along the centerline thereof with one end of the housing 12 including an opening 14 through which extends a support cable 16 that can be anchored in any suitable manner to a portion of the building structure from which the fire escape device 10 is supported. Depending from the bottom of the housing 12 is a support cable 18 having some means thereon for supporting engagement with a person to be lowered to a safe location from an elevated floor in a building structure during energency situations such as when there is a fire in the building. A transverse shaft or rod 20 extends between the side walls of the housing 12 adjacent the lower end thereof with the cable 18 being secured to the shaft 20. The ends of the shaft 20 include reduced threaded end portions 22 threadedly receiving shouldered nuts 24 thereon to fixedly secure the shaft 20 between and to the side walls of the housing 12 as illustrated in FIG. 2.

Mounted interiorly of the housing 12 adjacent the opposite end thereof is a cable drum 26 having the cable 16 wound thereon in a conventional manner with the drum 26 including end flanges 28 to retain the cable thereon. The drum 26 includes a cylindrical hub 30 extending through the center thereof journalled on a shaft 32 having reduced threaded ends 34 threaded into shouldered nuts 36 extending through openings in the side walls of the housing 12 thereby rotatably journalling the drum 26 from the housing 12. One of the end flanges 28 on the drum 26 is in the form of a spur gear 38 which is in meshing engagement with an idler gear 40 mounted on a stub shaft 42 that has a reduced threaded end 44 received in a retaining nut 46. The retaining nut 46 is in locking engagement with an inner partition wall 48 spaced from the housing 12 as illustrated in FIG. 2 with the shouldered shaft 42 engaging the opposite surface of the partition wall 48. The partition wall 48 is oriented in spaced opposed relation to a similar partition wall 50 which are joined together in spaced relation at one end by an end member 52 and which are spaced from the housing walls by spacers 54 located between the interior of the housing 12 and the partition members 48 and 50 with the spacers 54 being screw threaded on the reduced ends 34 of the shaft 32 thus locking the shaft to the housing and providing a structure whereby the shaft 32 is stationary and the drum 26 rotates thereon. Likewise, the lower ends of the partition members 48 and 50 are spaced from the inner surfaces of the housing 12 by similar spacers 55 which coact with the reduced threaded ends 22 and the shouldered nuts 24 in the same manner to securely lock the shaft 20 in place on the partitions 48 and 50 and to the housing 12.

Figure 2:
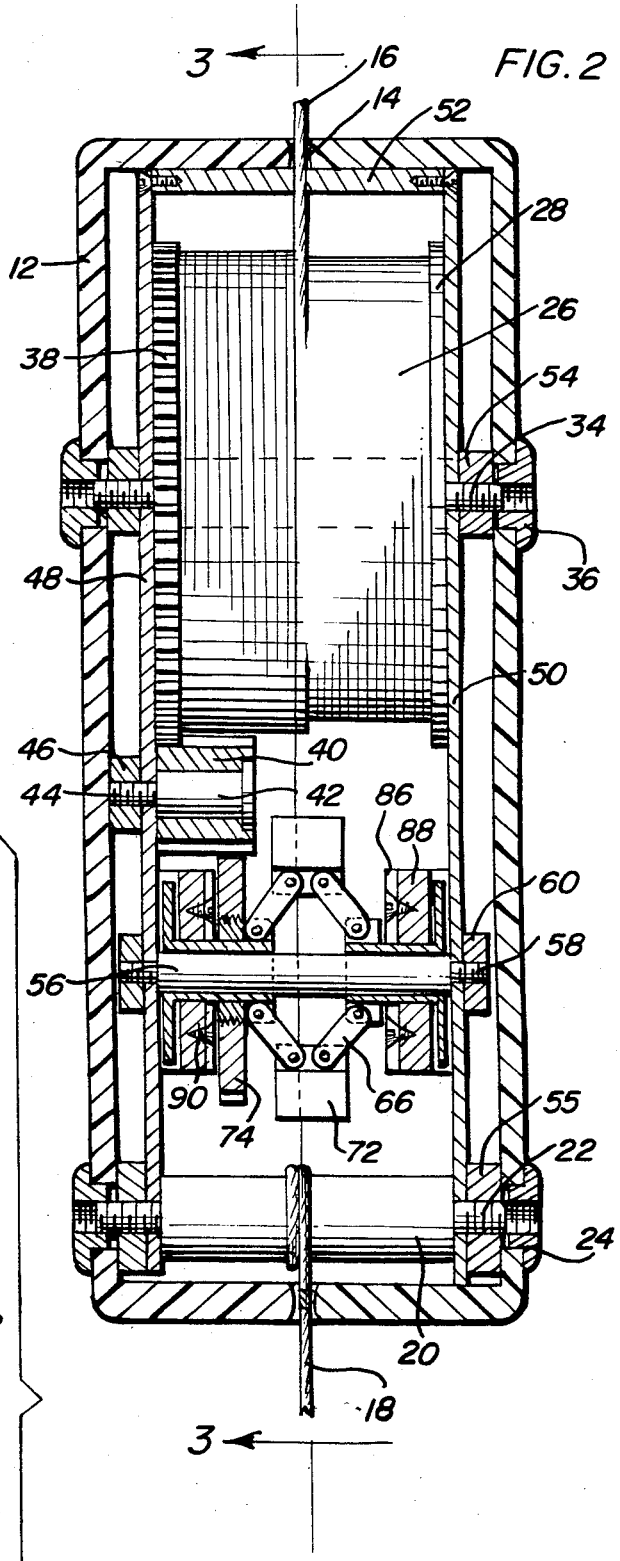
FIG. 2 is a vertical sectional view, on an enlarged scale, taken substantially upon a plane passing along section line 2—2 on FIG. 1 illustrating specific structural details of the fire escape device.
Figure 4:
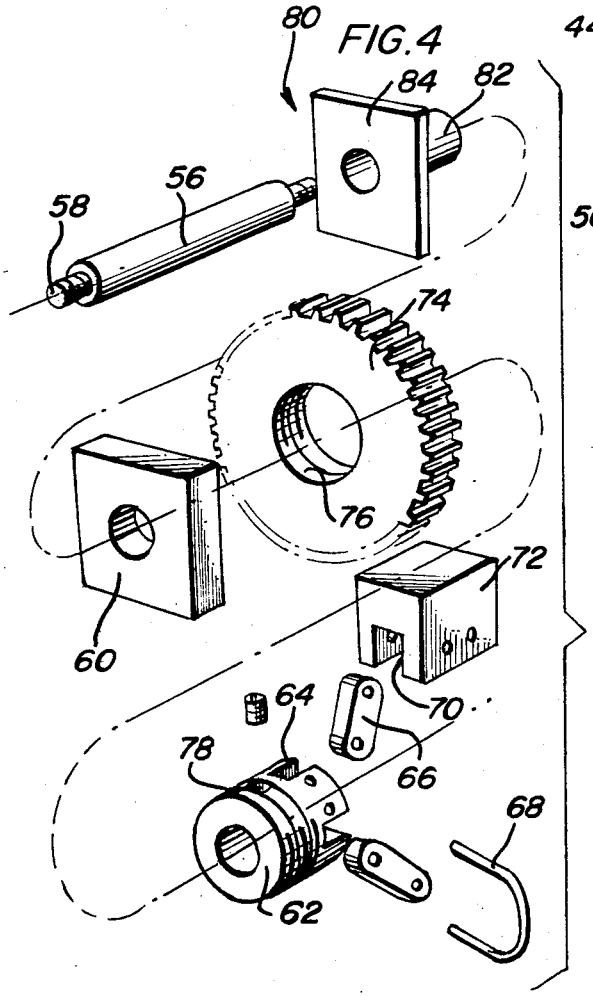
FIG. 4 is an exploded group perspective view of several of the components of the fire escape device of the present invention.
Figure 3:
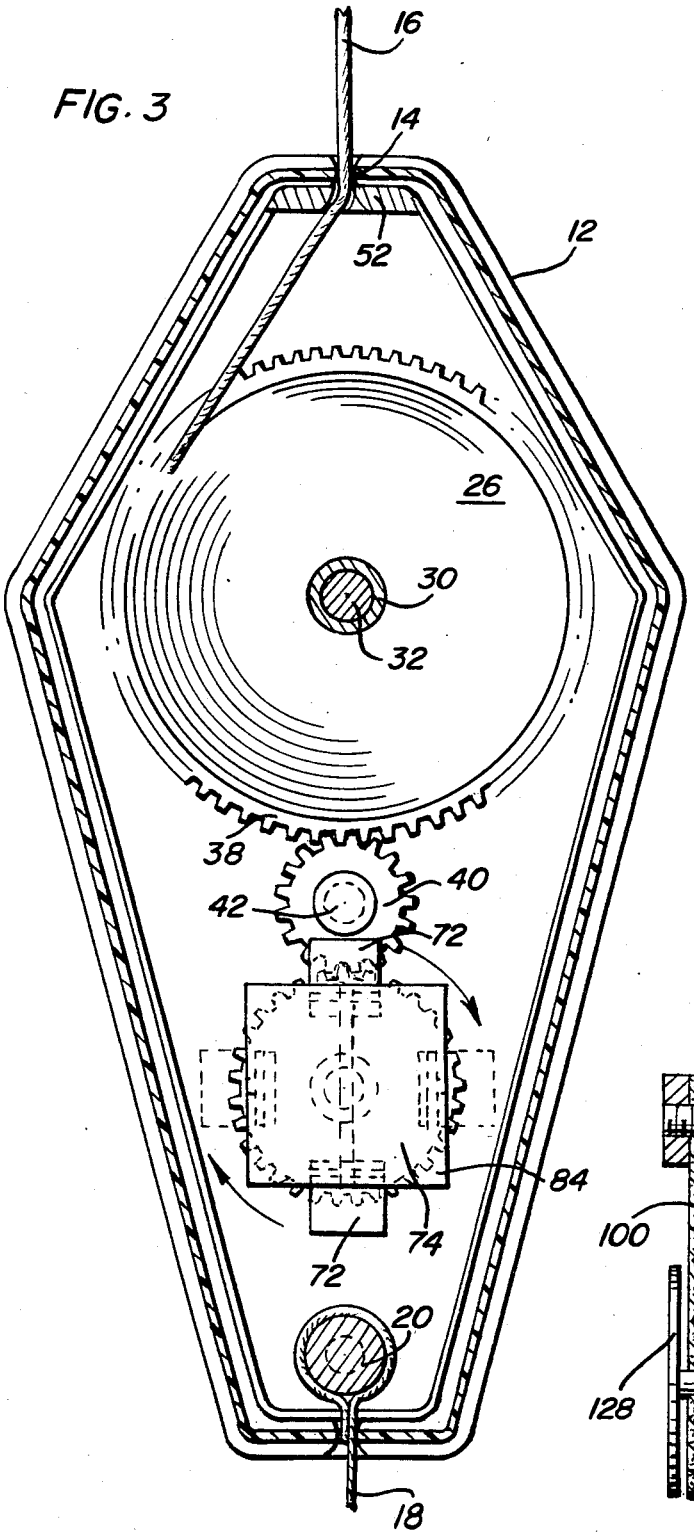
FIG. 3 is a vertical sectional view taken substantialy upon a plane passing along section line 3—3 on FIG. 2 illustrating further structural details of the fire escape device.

Mounted between the partitions 48 and 50 is a shaft 56 having reduced threaded ends 58 extending through the partitions and in threaded engagenent with nuts 60 positioned between the interior of the housing 12 and partitions 48 and 50 respectively as illustrated in FIG. 2. Mounted rotatably with respect to the shaft 56 is a pair of tubular members 62 each of which has a plurality of notches 64 in the inner end thereof for pivotally mounting a plurality of links 66 therein by a U-shaped pivot pin 68 with the outer end of each link 66 being received in a notch 70 in a centrifugal weight 72 with the two links 66 enabling radial inward and outward movement of the weights 72 with the tubular members or sleeves 62 sliding axially with respect to the shaft 56 so that when the weights 72 are rotated about the axis of the shaft 56, centrifugal force will cause outward movement thereof and corresponding inward movement of the tubular sleeves 62. As illustrated in FIG. 2, one of the tubular sleeves is provided with a spur gear 74 mounted thereon in meshing engagement with the gear 40 with the gear 40 being sufficiently long to enable sliding movement of the gear 74 while retaining its meshed relationship so that the tubular sleeve 62 having the gear 74 thereon will be driven by the gear 40 and correspondingly, the tubular sleeve 62 in opposed relation to the sleeve having the gear 74 thereon will correspondingly be rotated. The gear 74 is fixedly secured to the tubular sleeve 62 in any suitable manner such as by a secure screw threaded connection with the gear 74 having an internally threaded aperture 76 therein and the sleeve 62 having an externally threaded portion 78 on one end thereof. Setscrew arrangements, Woodruff keys or other similar arreangements may be provided for securing the gear 74 to the tubular sleeve 62.

Positioned on the shaft 56 is a pair of brake members 80 each of which includes a tubular member 82 and a plate 84 rigid with one end thereof with the tubular member 82 being journalled on the shaft 56 and also axially slidable thereon and telescopically received within the tubular sleeve 62 and rigidly connected thereto so that the plate 84 rotates with the gear 74, the tubular sleeves 62, the links 66 and weights 72 with the tubular members 82 and plate 84 moving axially along the shaft 56 when the weights 72 move radially outwardly and inwardly.

Mounted stationarily from each of the partitions 48 and 50 is a brake member or plate 86 having a friction pad 88 mounted on the outer surface thereof by suitable fasteners 90 with suitable brackets rigidly fixing the plate 86 to the partitions 48 and 50 respectively so that the brake pad 88 will be stationarily supported in spaced relation to the inner surface of the respective partition mamber 48 and 50 so that the brake paltes 84, when moved axially inwardly, will frictionally engage the brake pads 88 thereby slowing rotational movement of the brake plates 84 and correspondingly slowing rotational movement of the tubular sleeves 62, the gear 74, gear 40, gear 38, and cable drum 26 thereby slowing the descent of a person supported from the cable or other supporting structure 18 by controlling the rate of unwinding of the cable 16 from the drum 26.

Figure 5:
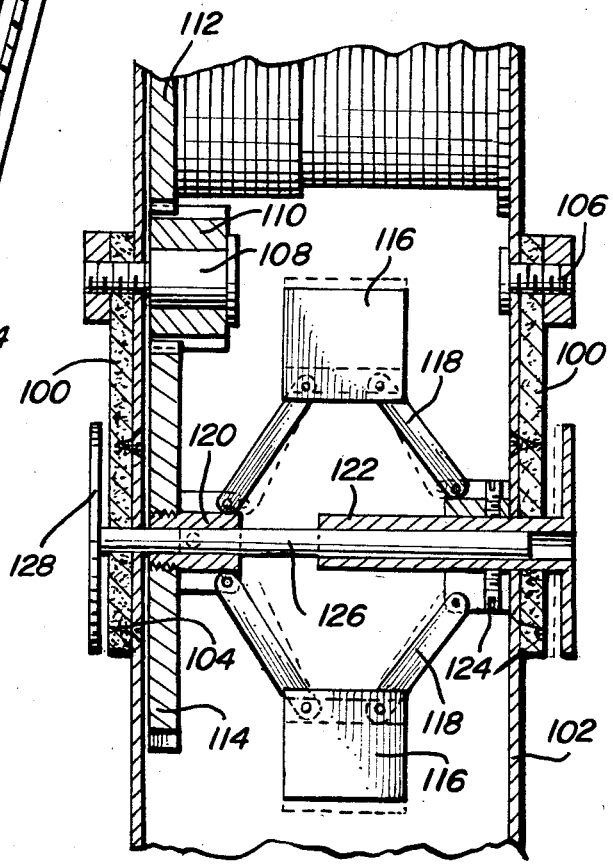
FIG. 5 is a fragmental view similar to FIG. 1 but illustrating a slightly different embodiment of the brake mechanism.

FIG. 5 illustrates a slightly modified form of the invention in which the brake assembly is simplified and provided with less components. In this form of the invention, the drive from the drum is the same as in FIGS. 1–4. In this construction, a brake pad 100 is mounted exteriorly of housing 102 on each side thereof and secured in place by suitable fasteners 104, bonding with adhesive or other suitable means with one end of the pads 100 being secured to the housing by fasteners 106, one which is the end of a supporting stub shaft 108 for journalling the idler gear 110 which is in meshing engagement with the cable drum gear 112 and gear 114 associated with the brake machanism. The brake mechanism includes a plurality of rotating weights 116 connected by a pair of links 118 to a pair of tubular sleeves 120 that are fixedly secured to tubular members 122 and shaft 126 by setscrews 124 or other suitable fastening means with the tubular member 122 being slidable on the shaft 126 that is slidable through the housing 102 with the sleeve 122 and shaft 126 extending through the housing and through the brake pads and terminating in brake plates 128 oriented externally of the housing and in opposed parallel relation to the brake pads 100. This embodiment of the invention operates in a similar manner to that illustrated in FIGS. 1–4 but is simplified since it involves less components with the brake pads and brake shoes or plates being disposed externally of the housing and providing a simpler mounting for the brake pads and brake plates which are movable into engagement with the pads. Both forms of the invention may be provided with a weight return spring to provide a slight return force to the springs to disengage the brakes by biasing the springs inwardly with a relatively lightweight spring which may be positioned between the inner ends of the tubular member 82 or 122.

While a mechanical brake arrangement has been provided utilizing centrifugal force of rotating weights, it is also contemplated that the radial movement of the weights may be transmitted to a brake device associated with the cable drum or spool through a hydraulic mechanism in which the radial movement of the weights will apply and release a brake mechanism for the cable drum through a hydraulic system similar to those used in conventional hydraulically actuated brakes.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fire escape device comprising a housing having a drum rotatably mounted thereon with, a flexible support member wound thereon and adapted to be unwound therefrom during descent of a person supported by the fire escape device, the improvement comprising a brake mechanism associated with the drum to control the rotational speed thereof thereby controlling the velocity of a person being lowered by the fire escape device, said brake machanism comprising rotatable, radially movable weights, means drivingly interconnecting the drum and rotatable weights to rotate the weights in direct proportion to the rotational speed of the drum, and brake means connected to the rotatable weight drive means for applying a retarding force to the rotatable weight drive means to control the rotational speed of the weights and thus control the rotational speed of the drum, said rotatable weights are mounted on shaft means, axially movable tubular members mounted on the shaft means and connected to the weights by inclined links whereby radial inward and outward movement of the weights moves the axially movable members, said brake means including a stationary brake pad associated with each of the opposite sides of the housing and a brake plate carried by each of the axially movable members for frictional engagement with the brake pads when the weights move radially outwardly, said means drivingly interconnecting the drum and weights comprising a gear assembly including a driving gear rigid with said drum, an elongated idler gear meshing with said driving gear and being rotatably supported on said housing and a driven gear fixedly mounted on one of said axially movable members and in sliding meshing engagement with the idler gear.

2. The fire escape device as defined in claim 1 wherein said brake pads and brake plates are oriented inwardly of the housing with the brake pads being spaced from the inner surfaces of the housing and said brake plates being positioned between the inner surface of the housing and the brake pads for frictionally engaging the brake pads upon inward movement.

3. The fire escape device as defined in claim 1 wherein said brake pads are stationarily mounted exteriorly of the housing, said brake plates being disposed exteriorly of the housing in slightly spaced relation to the brake pads until the rotating weights reach a predetermined speed at which time outward movement of the weights about their rotational axis will move the brake plates into engagement with the brake pads for frictionally reducing rotational movement of the weights and drum.

4. The fire escape device as defined in claim 1 wherein said housing completely encloses the drum and gear assembly with the flexible support member being a cable and the drum being a cable drum with end flanges, said driving gear being formed on one of said end flanges, said axially movable tubular member having the driven gear fixedly attached thereto being oriented adjacent the same side of the housing as the driving gear, said idler gear being supported by a stub shaft fixed to the housing adjacent the same side thereof as the driving gear and driven gear, said links connecting the weights to the axially movable tubular members being identical for exerting equal axial force on each of the axially movable tubular members to apply braking force to the driven gear from both of said brake pads and brake plates.

* * * * *